US005236577A

United States Patent [19]

Tipman et al.

[11] Patent Number: 5,236,577

[45] Date of Patent: Aug. 17, 1993

[54] PROCESS FOR SEPARATION OF HYDROCARBON FROM TAR SANDS FROTH

[75] Inventors: Robert N. Tipman; Bruce M. Sankey, both of Calgary, Canada

[73] Assignee: Oslo Alberta Limited, Calgary, Canada

[21] Appl. No.: 844,867

[22] Filed: Mar. 2, 1992

Related U.S. Application Data

[63] Continuation of Ser. No. 668,572, Mar. 12, 1991, abandoned.

[30] Foreign Application Priority Data

Jul. 13, 1990 [CA] Canada ..... 2021185

[51] Int. Cl.[5] ..... C10G 1/04

[52] U.S. Cl. ..... 208/390

[58] Field of Search ..... 208/390

[56] References Cited

U.S. PATENT DOCUMENTS

| | | | |
|---|---|---|---|
| 3,901,791 | 8/1975 | Baillie | 208/390 |
| 4,035,282 | 7/1977 | Stuchberry et al. | 208/391 |
| 4,648,964 | 3/1987 | Leto et al. | 208/390 |

*Primary Examiner*—Theodore Morris
*Assistant Examiner*—P. L. Hailey
*Attorney, Agent, or Firm*—Arne I. Fors

[57] ABSTRACT

A process for treating bitumen froth containing mixtures of a hydrocarbon component, water and solids, comprises heating said bitumen froth to a temperature in the range of about 80° C. to about 300° C., preferably in the range of 100° C. to 180° C., under pressure of about 150 to about 5000 kPa, preferably in the range of 800 to about 2000 kPa, sufficient to maintain said hydrocarbon component in a liquid phase, passing said heated froth into a plurality of separation stages in series, and gravity settling the solids and water from the hydrocarbon layer while maintaining said elevated temperature and pressure. A diluent miscible with the bitumen may be mixed with the bitumen froth in an amount of 0 to about 60 per cent by weight of the bitumen, preferably in an amount of 15 to 50 per cent by weight of the bitumen in a mixing stage for preconditioning of the froth prior to each gravity separation stage. A low molecular weight hydrocarbon diluent, such as typified by naphtha, kerosene, toluene or natural gas condensate, is preferred.

15 Claims, 4 Drawing Sheets

FIG. 2. Effect of Temperature on Separation Rate
Froth/Diluent = 1/0.7 vol.

Effect of Temperature on Settling Parameter

PROCESS FOR SEPARATION OF HYDROCARBON FROM TAR SANDS FROTH

This application is a continuation of application Ser. No. 668,572 filed Mar. 12, 1991 (not abandoned).

BACKGROUND OF THE INVENTION

This invention relates to a process for separating bitumen from bitumen froth. More particularly, it relates to a process for separating bitumen by heating the bitumen froth at an elevated temperature and pressure and gravity separating the water and solid components from the bitumen froth.

The reserves of liquid hydrocarbons in bitumen deposits are very substantial and form a large portion of the world's known energy reserves. These deposits are relatively expensive to develop compared with conventional petroleum crude oils. The heavy oils are extracted from the deposits either by mining methods or in-situ steam injection. The mined ore is subsequently treated with steam, hot water and caustic in a hot water extraction process carried out at approximately 80° C. to liberate the bitumen from the sand to form a froth. This froth contains a significant portion of water and solids which must be substantially reduced prior to an upgrading step. Heavy oil produced by in-situ methods also contain significant quantities of water and solids which must be treated prior to upgrading. The upgrading processes convert the heavy oil to lighter fractions which can be further processed into naphtha, gasoline, jet fuel and numerous other petroleum products.

These heavy oils and bitumen froths are deaerated to remove entrained air and treated to remove significant water and solids. The most common method of purification is to dilute the produced froth or heavy oil with naphtha to reduce the viscosity. With bitumen froth, the naphtha is added in approximately a 1:1 ratio on a volume basis. The diluted bitumen may then be subjected to centrifugation in two stages. In the first stage, coarse solids are removed using scroll type machines. The product from this step is then processed in disc centrifuges which remove a significant portion of the water and solids. The naphtha diluent is recovered from this bitumen by flash distillation and recycled to the froth treatment step to be reused. In the case of insitu produced heavy oils, a similar diluent is added to reduce the heavy oil viscosity for the purposes of separation of solids and water and subsequent pipeline transport. The removed solids and water are disposed of in a tailings pond or other containment area. The diluent may either be recovered for reuse, or it may be left in the recovered heavy oil to be used in pipeline transport of the product.

The bitumen or heavy oils are upgraded or refined in processes such as fluid coking, LC-Fining TM, residuum hydrotreating or solvent deasphalting. It is desirable to eliminate essentially all the water and to reduce the solids to less than 1 per cent by weight before proceeding with any of these processes. The conventional specification for pipeline feed of oil is a maximum of 0.5 per cent bottom sediment and water (BS&W). With bitumen produced from froths by centrifugation following conventional mining and extraction processing, the solids content of the bitumen is seldom less than 1 per cent. From in-situ production, the specification of 0.5 per cent BS&W may be achieved Various methods have been used to remove water and solids from such froths. Given et al (U.S. Pat. No. 3,338,814) describe a process whereby froths produced by hot water extraction of bitumen are dehydrated by heating to temperatures from 225° F. to 550° F. (preferably 350° F. to 450° F.). The dehydrated bitumen, containing 5% to 25% solids is then subjected to cycloning or filtration to remove solids. In a variation to the basic process, a light hydrocarbon can be added to the dry bitumen to improve the filtration step. The hydrocarbon can be recovered by distillation and recycled. This is essentially a two-stage process that requires a considerable amount of energy in order to obtain a satisfactory degree of extraction.

Another attempt to remove water and solids from bitumen froths was disclosed by Leto et al (U.S. Pat. No. 4,648,964). In this process, bitumen froths are heated to temperatures above 300° C. at pressures above 1000 psig to heat/pressure treat the froth prior to separation of a hydrocarbon layer from water and solids at atmospheric pressure in a second stage. The second stage of the process requires pressure reduction and cooling of the material to a temperature about 80° C. Naphtha, in a weight ratio of naptha to treated stream in the range of 0.5–1.0:1.0, is then added to the bitumen and the mixture is introduced into a gravity separation vessel at atmospheric pressure. The hydrocarbon is withdrawn from the top of the vessel and a solids and water fraction is removed from the bottom. The bottoms are transferred to a second settling vessel where clarified water is withdrawn from the overflow and solids are removed from the underflow for disposal. Since this process requires extremely high temperatures and pressures and a relatively intricate apparatus for controlling the changing temperatures and pressures from a high pressure separation in a first stage to atmospheric pressure separation in a second stage of the two-stage process, the extraction costs are relatively high.

Baillie (Canadian patents 952,837, 952,838, 952,839 and 952,840) discloses embodiments of a method for upgrading bitumen froth in which diluted bitumen froth recovered from a scroll centrifuge is heated to a temperature in the range of 300°–1000° F. and transferred to an autoclave settling zone for settling at a pressure in the range of 0–1000 psi. The tailings are cooled and passed to a disc centrifuge for secondary recovery at ambient pressure. This process requires the use of expensive centrifuges which are costly to operate and maintain and which are prone to shut-down due to wear because of the erosive nature of the material treated. In addition, the method requires the use of higher boiling liquid hydrocarbon diluents boiling in the range of 350°–750° F. and necessitates the steps of pressure reduction and cooling for the secondary stage disc centrifugation at atmospheric pressure.

A process developed by Shelfantook et al (U.S. Pat. No. 4,859,317) as an alternative to conventional dilution centrifuging circuits for purifying bitumen froths proposes three states of inclined plate settlers to remove water and solids from bitumen froths. This process is carried out at approximately 80° C. using naphtha as diluent in a 1:1 volume ratio based on the oil content in the froth. The lower temperature operation however results in a diluted bitumen product which contains a significant quantity of solids. The residual solids are at substantially higher levels than the specification required for pipelining and for some refining processes.

It is a principal object of the present invention to provide an improved process for effectively separating the bitumen component from the water and solids components of a bitumen froth by treating the froth at a relatively moderately elevated temperature and pressure, and gravity separating the said components while maintaining said temperature and pressure.

It is another object of the present invention to provide an improved process for separating the bitumen component from the water and solids of a bitumen froth using a substantially constant elevated temperature and pressure during the separation stages for enhanced recovery of bitumen with the use of simple and relatively inexpensive gravity separation equipment.

SUMMARY OF THE INVENTION

These and other objects of the invention are obtained by means of a process for treating bitumen froth containing mixtures of a hydrocarbon component, water and solids comprising heating said bitumen froth to a temperature in the range of about 80.C to about 300.C under pressure of about 150 to about 5000 kPa sufficient to maintain said hydrocarbon component in a liquid phase, passing said heated froth into a plurality of separation stages in series and gravity settling the solids and water from the hydrocarbon layer while maintaining said pressure within the liquid phase range of the hydrocarbons Although the process of the invention has been found operative with diluent mixed with the bitumen in amounts of 0 to about 60 per cent by weight of the bitumen, depending on the characteristics of the bitumen froth and separating temperature, at temperatures of about 80° C. to about 300° C. the addition of a diluent hydrocarbon in the range of about 15 to 50 per cent by weight of the bitumen is preferred. The diluent provides a greater viscosity reduction and density difference for the hydrocarbon relative to solids and water.

The pressure in the separation preferably is in the range of about 100 to about 250 psig and the temperature preferably is in the range of about 100° C. to about 180° C.

It has been found that the preconditioning of a mixture of bitumen froth containing an oil component such as bitumen together with water and solids, followed by gravity settling, is highly effective for rejecting the water and solids contaminants. This preconditioning step comprises efficient mixing, possible addition of a diluent miscible with the oil component, and heating to a temperature in the range 80° C. to 300° C. Although temperatures above 300° C. may also promote separation, these high temperatures produce highly undesirable chemical cracking and oxidation reactions which can degrade the oil component, produce noxious gases such as hydrogen sulphide, and result in coke formation and fouling of heat exchange surfaces. Below 80° C., chemical reaction is insignificant but the separation process is much less effective. The range described in this application therefore represents an optimum for achieving effective separation without deleterious chemical reactions.

The mixture used as feedstock, and to which the main application of this process has been directed, is bitumen froth derived from oil sands extraction. However, other mixtures containing essentially the same components, namely mixtures of oil, water and solids, could also be advantageously treated by this process. Examples would include sludges from refining and petroleum-producing operations, tank cleaning and filter backwash residues, and in-situ produced heavy oils. It will accordingly be understood that the term "bitumen froth" used herein encompasses emulsions of il such as sludges, heavy oils and the like.

Final products form this process are a hydrocarbon phase essentially free of contaminants and a water/solids stream essentially free of oil.

The process of the invention will be described with reference to bitumen froth recovered from bitumen. Since bitumen froth, as produced, contains a significant amount of air which would be deleterious to the froth treatment process, this air must first be removed in a deaeration step. Deaeration is normally accomplished by heating the froth up to a temperature in the range of about 80° C.-100° C. and allowing air to separate and be withdrawn.

For conventional bituminous froth feedstock, two stages of mixing and settling to be described herein allow for meeting both a hydrocarbon phase specification and a tailings product specification. However, it is within the scope of this invention to add mixing and settling stages to effect further quality improvement on either the hydrocarbon phase or tailings phase if circumstances require.

The separation step itself is carried out in a vessel maintained at the required temperature and sufficient pressure to prevent vaporization of fluid components. Under these conditions the water droplets and solids particles, being denser than the continuous hydrocarbon phase, separate under the influence of gravity. It is well established in the scientific literature that the downward velocity of these particles increases as their diameter increases. One purpose of the preconditioning step referred to above is therefore to promote coalescence of small droplets into larger particles which settle faster; effective mixing prior to settling is designed to achieve this.

If a diluent is used in the process, both terminal streams from the separation step, namely hydrocarbon product and aqueous tailings, will contain some concentration of the diluent. Normally, this diluent must be recovered for recycle within the process and methods suitable for accomplishing this are distillation and membrane separation, which can be applied to both of the above streams. In the event that the product stream is to be pipelined, then some diluent may be necessary to reduce viscosity and density of the bitumen down to levels acceptable for pipelining. It would be advantageous in this instance to permit all or part of the diluent in the hydrocarbon product stream to remain with the bitumen; this could be accomplished either by a partial diluent recovery step, or by elimination of diluent recovery completely at the froth treatment plant.

Ultimate disposal of the tailings requires a facility for allowing the fine solids to be removed from water. Conventionally, a settling pond is used for this purpose; after sufficient time has elapsed to settle most of the fine solids present, water can be withdrawn and the solids allowed to compact.

BRIEF DESCRIPTION OF THE DRAWINGS

The process of the invention will now be described with reference to the accompanying drawings, in which.

DETAILED DESCRIPTION OF THE INVENTION

Figure 1:
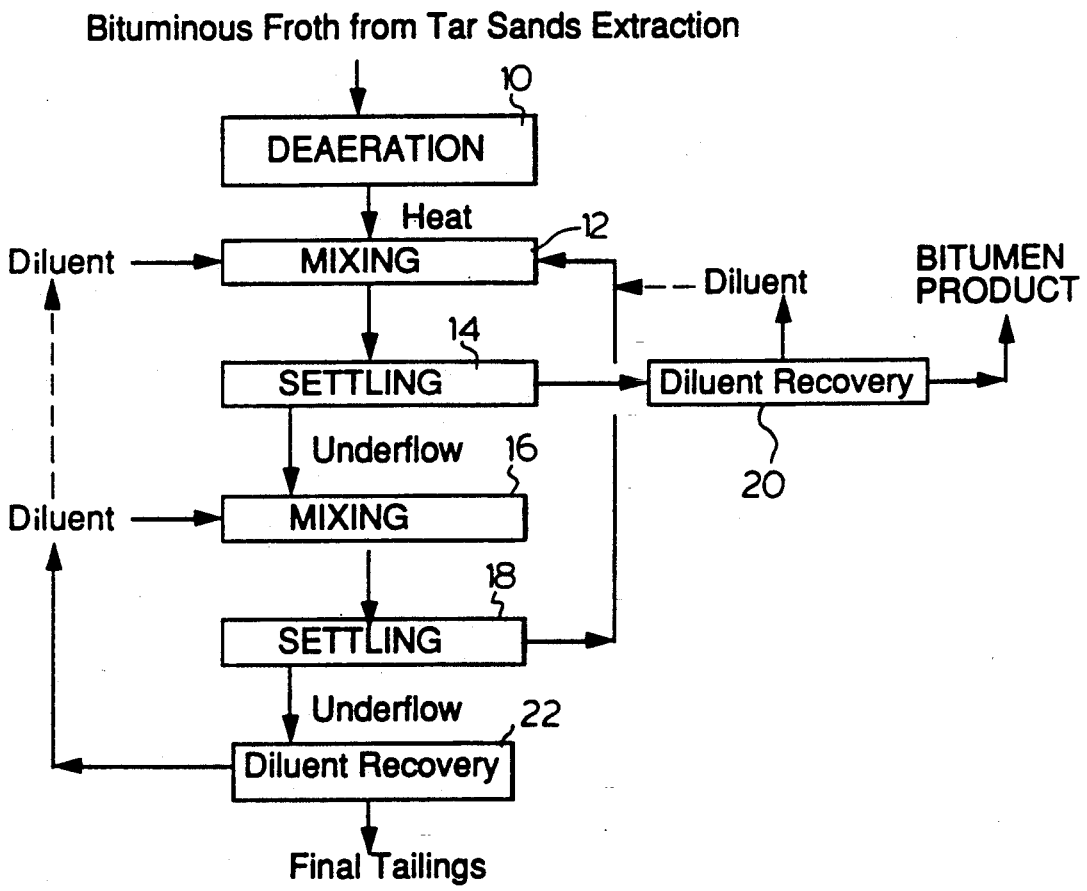
FIG. 1 is a schematic flow diagram of a preferred embodiment of the present invention.

A flow diagram of the bitumen froth treating process of the invention is shown in FIG. 1. A stream of bitumen froth is heated to a temperature in the range of about 80° C. to 100° C. prior to feed to deaeration stage 10 where sufficient residence time is provided in a deaeration tank to allow air to separate from the froth. The deaerated froth is heated to a temperature in the range of about 100° C. to 300° C. while a pressure is provided sufficient to maintain light hydrocarbon components in the liquid phase and to prevent vaporization. A pressure in the range of about 800 kPa up to about 5000 kPa was found to be suitable.

It was observed that the temperature range of about 100° C. to about 300° C. is sufficiently high to give a large viscosity reduction in the bitumen component to enhance separation of solids and water therefrom, to be described while maintaining the temperature below the point of thermal degradation. While some temperature and pressure changes are permitted for purposes of operability, the said temperature and pressure ranges are essentially maintained. Heat can be provided in a heat exchanger using steam or hot oil.

A low molecular weight hydrocarbon diluent, such as typified by naphtha, kerosene, varsol, toluene or natural gas condensate, may be added to the deaerated froth and the mixture heated or the diluent may be heated separately prior to feed to mixing stage 12. A naphtha diluent having 90% volume of the naphtha boiling between about 50° C. and 170° C., for example, was found to be effective. The bitumen-diluent mixture preferably is mixed in a mixer for preconditioning to yield a homogeneous hydrocarbon liquid phase and to provide a greater viscosity reduction and density difference relative to solids and water prior to feed to settling stage 14 for gravity separation.

If the water content of the froth is low, additional water can be added before or after mixing stage 12 to provide a carrier phase for transport of solids to be settled in settling stage 14.

The preconditioned bitumen froth is fed to settling stage 14 and component layers of bitumen and settled solids and water are formed and maintained for a period of time sufficient for the bitumen to collect on the surface and the water and solids to collect as sediment in the bottom of a settling vessel in settling stage 14.

The water-solids are separated out to a desired degree and discharged as underflow for a secondary separation with addition of diluent, if necessary, and mixing in second mixing stage 16 for preconditioning prior to feed to a second settling stage 18 for gravity separation at essentially the same pressure within the range of from about 10 to about 750 psig and within the temperature range of up to 300° C. A further repeat of this operation may be desired if sufficient quantities of bitumen remain mixed with the solids.

Underflow passing from settling stage 14 through mixing stage 16 to settling stage 18, and the several ancillary recycle flow and product lines, are continuously maintained at an elevated pressure sufficient to maintain light hydrocarbons in the liquid phase and to prevent vapourization of water, and to drive the components through the system by pressure. The initial pressurizing of preconditioned bitumen froth fed to settling stage 14 is adequate to maintain the desired elevated pressure throughout the system thereby avoiding the need for several stages of pumps and precluding the need to cool the streams below the boiling temperatures of the liquid components while retaining the advantage of separating the components at higher temperatures with attendant low viscosities.

The diluted bitumen component layer is passed from the settling stage 14 to diluent recovery stage 20 such as a conventional distillation vessel in which the diluent is distilled off and recycled, if desired, and the bitumen recovered for further processing in a manner well-known in the art. It may be preferred to leave a portion of all of the diluent in the bitumen product to facilitate pipelining of the product by meeting pipelining specifications. The bitumen thus is clarified to a crude oil grade suitable for pipeline transportation, i.e. oil containing less than 0.5% BS&W.

The diluted bitumen separated from second settling stage 18 can be combined with diluent in first mixing stage 12, and recycled to first settling stage 14. The water-solids from settling stage 18 are discharged as underflow substantially free of bitumen and residual diluent can be recovered in a diluent recovery stage 22 such as a conventional distillation vessel. Recovered diluent can be recycled to second mixing stage 16 or to first mixing stage 12.

The advantage of operating at uniform pressure throughout the treating and separation stages is particularly demonstrated by the simplicity of the continuous extraction process and surprisingly high yield of clean bitumen product. Unlike prior art processes for hydrocarbon recovery, the present multi-stage extraction process does not require raising and lowering pressure at various stages and thus by maintaining a substantially uniform pressure throughout the system, even when a diluent is added, continuous maintenance of a desired high temperature is permitted for optimum separation of bitumen from water and solids.

The process of the invention will now be described with reference to the following non-limitative examples.

EXAMPLE 1

The rate at which the froth components are gravity separated under pressure is strongly influenced by the temperature within the separation vessel. A sample of bitumen froth was mixed with diluent in the ration 60:40 by volume of froth:diluent and separated into two equal samples. One sample was settled at ambient temperature (25° C.) and the other at elevated temperature (180° C.). The latter sample was pressured to 250 psig in an autoclave in order to prevent vaporization of any lighter components. After a settling time of 30 minutes, the top phase in each test was sampled and analyzed to give the results shown in Table 1. Quality of the hydrocarbon phase, in terms of solid and water content, is markedly superior for settling at higher temperature and pressure.

TABLE 1

LABORATORY SEPARATION AT HIGH AND LOW TEMPERATURE
Froth/diluent ratio = 60/40 volume

| | Composition wt % (ex diluent) | | |
|---|---|---|---|
| | Oil | Solids | Water |
| Feed froth | 63.7 | 17.5 | 18.8 |
| Bitumen phase settled at 25° C. | 86.4 | 2.2 | 11.4 |
| Bitumen phase settled at 180° C. | 94.4 | 0.4 | 5.2 |

EXAMPLE 2 the aqueous tailings stream (bottom phase #1) from a single stage separation of bitumen froth contained some bitumen, as shown in Table 2. This stream was recontacted in a second stage with more diluent and settled again. Bitumen recovery was increased from 91 wt% for a single stage to 98.5 wt% for the two stages.

TABLE 2

EFFECT OF MULTIPLE STAGES ON HIGH TEMPERATURE SEPARATION
Material balance derived from batch experimental data
All data on weight basis, relative to 100 wt units of froth

| | Stage #1 | | | Stage #2 | |
|---|---|---|---|---|---|
| Component | Feed to Stage #1 | Top Phase #1 | Bottom Phase #1 | Top Phase #2 | Bottom Phase #2 |
| Bitumen | 65 | 59 | 6 | 5 | 1 |
| Solids | 9 | 0.5 | 8.5 | 0.1 | 8.4 |
| Water | 26 | 1 | 25 | 1 | 24 |
| Froth | 100 | | | | |
| Diluent | 41 | 40 | 1 | 20 | ~1 |
| | | | +20 added for stage #2 | | |

Bitumen recovery from first stage = 91%
Bitumen recovery from two stages = 98.5%

EXAMPLE 3

Two different types of bitumen froth were obtained, one from a conventional hot water extraction utilizing caustic addition, as employed at commercial plants in Alberta, Canada, and one experimental froth generated without the use of caustic. Composition of these froths is shown in Table 3; although the bitumen content is similar, the ratio f solids to water is quite different owing to the different extraction processing.

Each feed froth was separated at 80° C. and 180° C., and at one intermediate temperature of 115° C. or 166° C., in batch autoclave runs. This autoclave, of one liter capacity, was charged with the feed mixture, sealed, then stirred while being heated to the target temperature. After reaching this temperature, mixing was stopped and samples taken into small sample bombs at various time intervals. The data shown in Table 3 refer to 20 minutes settling time, and clearly illustrate that the product quality, in terms of residual solids and water content, improves with separation at higher temperature. Similar improvements observed with the two different froth types indicate that this phenomenon is of wide applicability.

TABLE 3

FROTH SEPARATION IN BATCH AUTOCLAVE

| Temperature °C. | Diluent wt % on bit. | Product Composition, wt %[1] Oil | Solids | Water |
|---|---|---|---|---|
| (a) Feed-derived from Hot Water Extraction process with caustic addition | | 56 | 8 | 36 |

TABLE 3-continued

FROTH SEPARATION IN BATCH AUTOCLAVE

| Temperature °C. | Diluent wt % on bit. | Product Composition, wt %[1] Oil | Solids | Water |
|---|---|---|---|---|
| 80 | 41 | 91.4 | 1.6 | 7.0 |
| 115 | 41 | 96.7 | 0.5 | 2.8 |
| 180 | 41 | 98.5 | 0.1 | 1.5 |
| (b) Feed-derived from non-caustic process | | 55 | 17 | 28 |
| 80 | 44 | 91.7 | 1.6 | 6.7 |
| 166 | 38 | 96.5 | 2.1 | 1.4 |
| 180 | 44 | 99.0 | 0.4 | 0.6 |

[1]Settling time = 20 minutes

EXAMPLE 4

Figure 2:
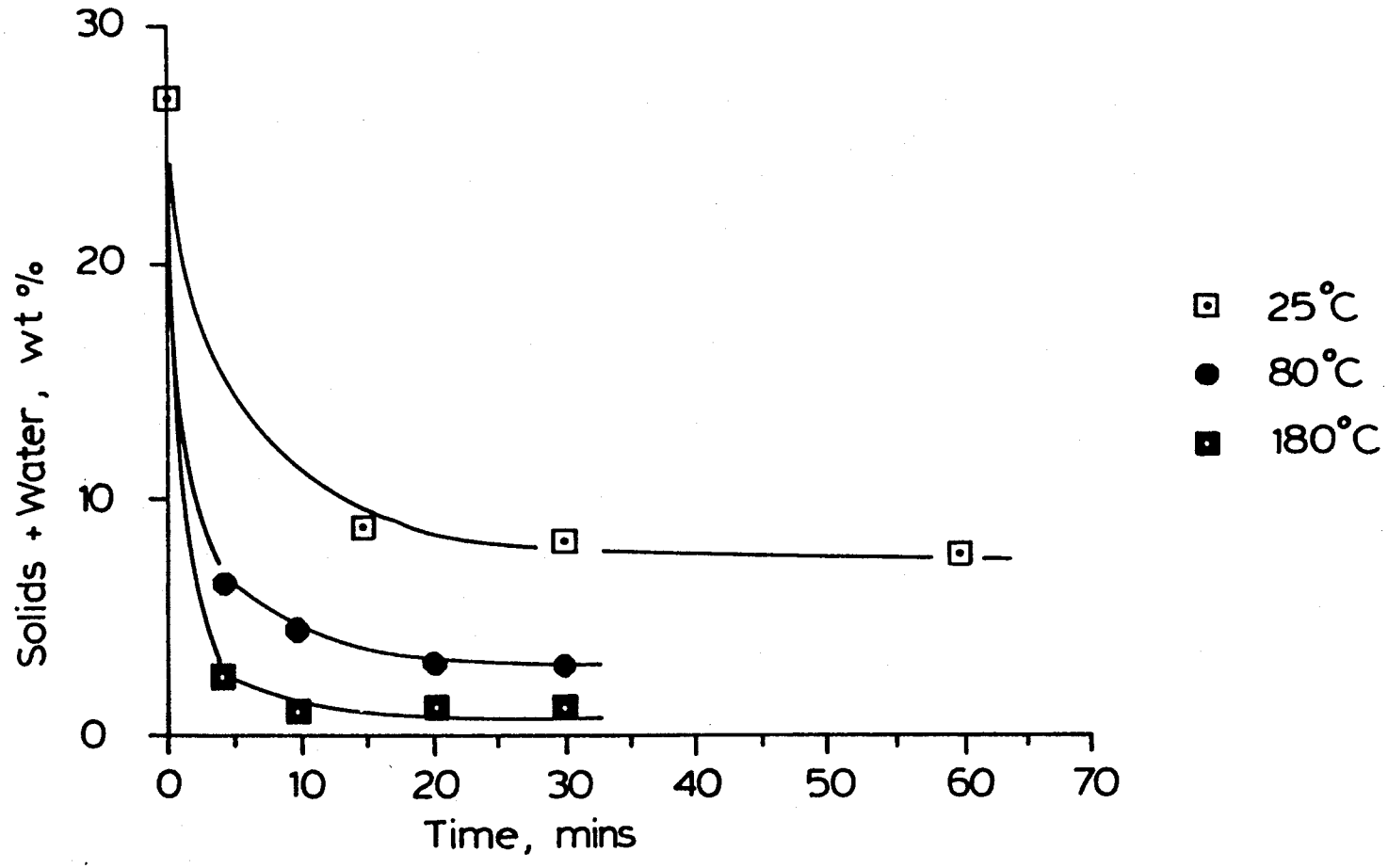
FIG. 2 is a graph showing the separation rate of solids and water from bitumen at various temperatures.

Separation at higher temperatures gives not only benefits in terms of ultimate product quality but also in the increase in the rate of separation. The data plotted in FIG. 2 were obtained by charging an autoclave with froth and diluent, mixing, and heating up to desired temperature. At this temperature, mixing was stopped and small samples were taken at regular time intervals and analyzed for oil, water and solids components. The data clearly illustrate that higher temperatures provide both faster settling, in that contaminants are rejected more quickly, and in addition, provide an ultimately superior product quality at completion of settling.

This advantage in faster settling means that equipment size can be reduced, or that throughput for given equipment size can be increased over what would be possible at lower temperature.

EXAMPLE 5

It is common, in settling experiments, to cover a range of variables such as temperature, diluent/feed ratio and settling time. This number of variables makes correlation of results difficult. It is well known in the art that Stokes' Law represents gravity settling of particles from a continuous fluid phase. For a given system, Stokes' Law states that settling velocity of particles is inversely proportional to viscosity. The degree of settling will, in addition, depend on the settling time available. Hence a "Settling Parameter" can be devised which combines several variables and is defined as follows:

$$\text{Settling Parameter} = \text{settling time}/\text{viscosity}$$

Viscosity in turn will be a function of temperature and diluent/feed ratio.

Figure 3:
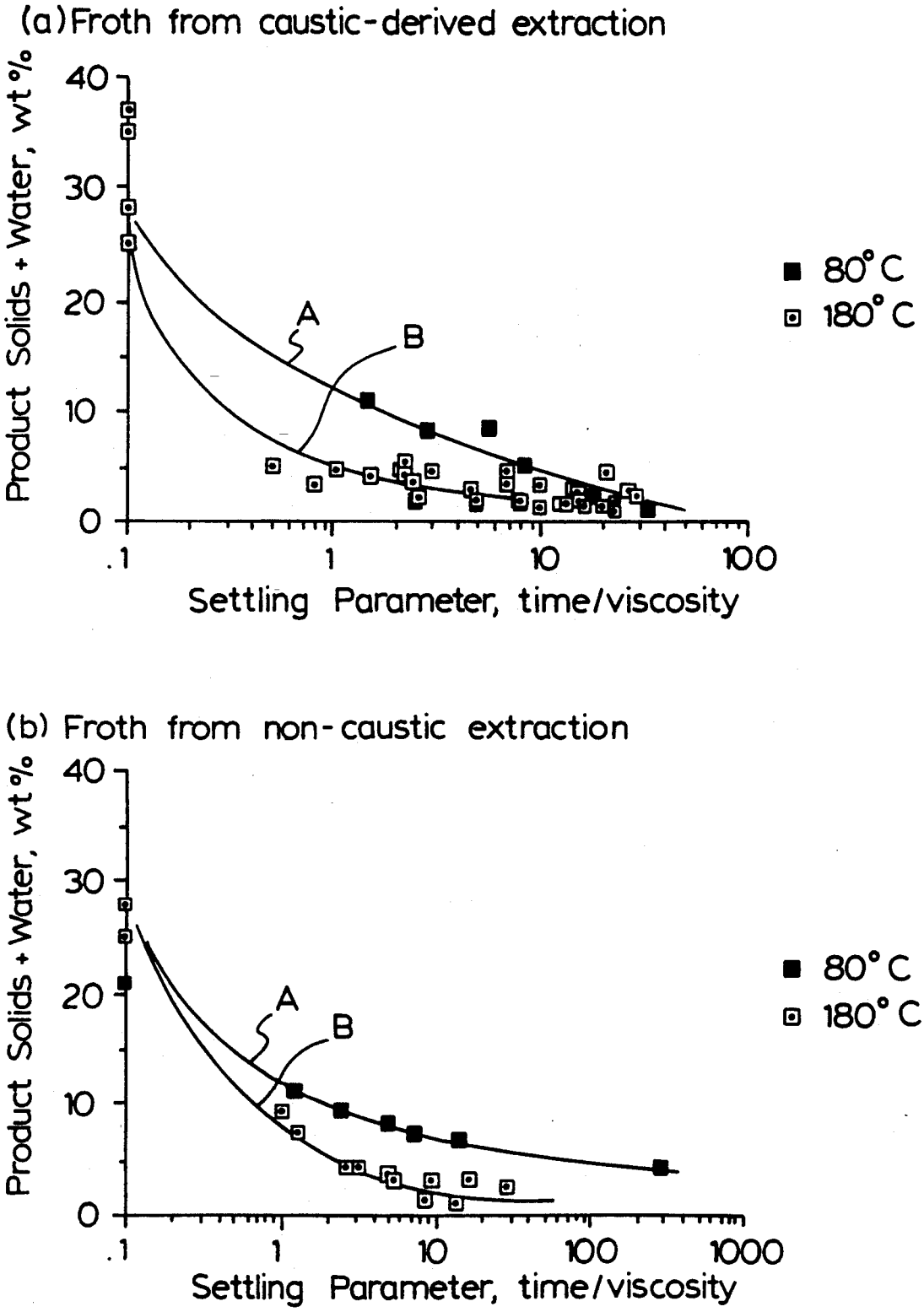
FIGS. 3(*a*) and 3(*b*) are graphs comparing the settling behaviour of froth constituents at different temperatures.

It follows from the above relationship that product quality should correlate with the Settling Parameter, as a means of normalizing the data. Results from autoclave runs are plotted in FIGS. 3(*a*) and 3(*b*). The high temperature results show a definite and unexpected benefit over that related simply to predictable viscosity effects. For example, a given viscosity can be achieved either at 180° C. or at 80° C. by adding more diluent. Stokes' Law would then predict equivalent settling rates. However, as FIGS. 3(*a*) and 3(*b*) show, this is not the case; higher temperature settling shows an unexpected and unique benefit, on both froth types studied. As evident from FIGS. 3(*a*) and 3(*b*), for a given value of settling parameter, separation at higher temperature as shown in Curve B provides unexpectly lower solids and water in the product compared to the lower temperature separation as shown in Curve A.

EXAMPLE 6

Very slow settling of solids and water from bitumen froth will occur without diluent addition over a period of weeks or months at ambient temperature, but this is not a practical basis for a process. However, at elevated temperature, this separation does become feasible. The data in Table 4, generated from an autoclave experiment using froth only, with no added diluent, show effective separation of solids and water from the bitumen at a temperature of 180° C. At 80° C. under the same conditions, no significant separation occurs.

TABLE 4

HIGH TEMPERATURE FROTH SEPARATION WITHOUT DILUENT
Conditions: Froth from Hot Water Extraction
Mixing/Settling Temperature: 180° C.

| | Settling Time | Composition, wt % | | |
|---|---|---|---|---|
| | mins | Oil | Solids | Water |
| Product Phase | 0 | 65.3 | 6.5 | 28.2 |
| | 3 | 73.8 | 4.8 | 21.4 |
| | 20 | 93.5 | 0.8 | 5.7 |

Bitumen Recovery: 90 wt %

EXAMPLE 7

Efficient mixing, prior to gravity settling, is an important aspect of the present invention, particularly with respect to the second stage, which determines the ultimate bitumen recovery. Batch runs were performed in an autoclave at different temperatures and mixing intensity, as shown in Table 5, Feed for these runs comprised the tailings stream from a prior separation of bitumen froth, with the composition as shown. Naphtha diluent was added and the mixture stirred in an autoclave as it was heated up to temperature. Any oil recovered form this feed floated to form a light phase and the remaining heavy phase was analyzed. At 180° C. with a low level of mixing, the oil content and solids/oil ratio remained at about the feed level. However, at higher mixing severity, a major reduction in oil remaining in the bottom phase was achieved, corresponding to an increase in overall bitumen recovery from about 90 to 97 wt%.

TABLE 5

THE IMPORTANCE OF MIXING INTENSITY FOR OIL RECOVERY
Feed: Tailings from first stage separatin (froth + diluent)
Tailings/naphtha = 2/1 wt

| Temp. | Mixer | Second Stage Tailings Composition, wt % | | | Solids/ Oil | Est. Overall Bit. recovery |
|---|---|---|---|---|---|---|
| °C. | rpm | Oil | Water | Solids | ratio | wt % |
| Feed | — | 13 | 61 | 26 | 2.0 | 90 |
| 180 | 150 | 15 | 54 | 31 | 2.1 | 90.5 |
| 180 | 400 | 5 | 63 | 32 | 6.4 | 97 |

EXAMPLE 8

The purpose of added diluent is primarily to reduce viscosity of the continuous fluid phase, hence promote coalescence and settling of water droplets and solid particles. Any low viscosity hydrocarbon may therefore be utilized. Some examples of diluents are naphtha, kerosene and natural gas condensate. These comprise a boiling range from light hydrocarbons such as pentane to heavier hydrocarbons in the range of for example, 50° C. to 170° C. for 90% of naptha. Natural gas condensate comprises light paraffins such as hexane and heptane which are miscible with bitumen and represents the condensible liquids coproduced form certain natural gas fields.

In order to demonstrate that the present invention is applicable to a wide range of diluents, autoclave experiments were performed using froth derived from a commercial hot water extraction process together with one of the three diluents tested. After charging the mixture t the autoclave, it was sealed and stirred during heating up to temperature. The stirrer was then switched off and samples taken after 15 minutes. As the data in Table 6 illustrate the amount of solids and water remaining int he bitumen phase were significantly reduced at 180° C. versus 80° C. for each of the three diluent types.

TABLE 6

RANGE OF DILUENT TYPES TESTED
Froth: Derived from Hot Water Extraction Process
Froth/Diluent ratio = 1/0.6 wt
Settling Time = 15 minutes

| | Temp. | Oil Phase Composition, wt % | | | |
|---|---|---|---|---|---|
| Diluent | °C. | Oil | Solids | Water | Solids + Water |
| — | Feed | 78 | 5 | 17 | 22 |
| Naphtha | 80 | 95 | 1 | 4 | 5 |
| | 180 | 98 | 0.5 | 1.5 | 2 |
| Varsol | 80 | 96 | 1 | 3 | 4 |
| | 180 | 98.8 | 0.2 | 1 | 1.2 |
| Nat. Gas Cond. | 80 | 94 | 1 | 5 | 6 |
| | 180 | 97 | 0.5 | 2.5 | 3 |

EXAMPLE 9

Figure 4:
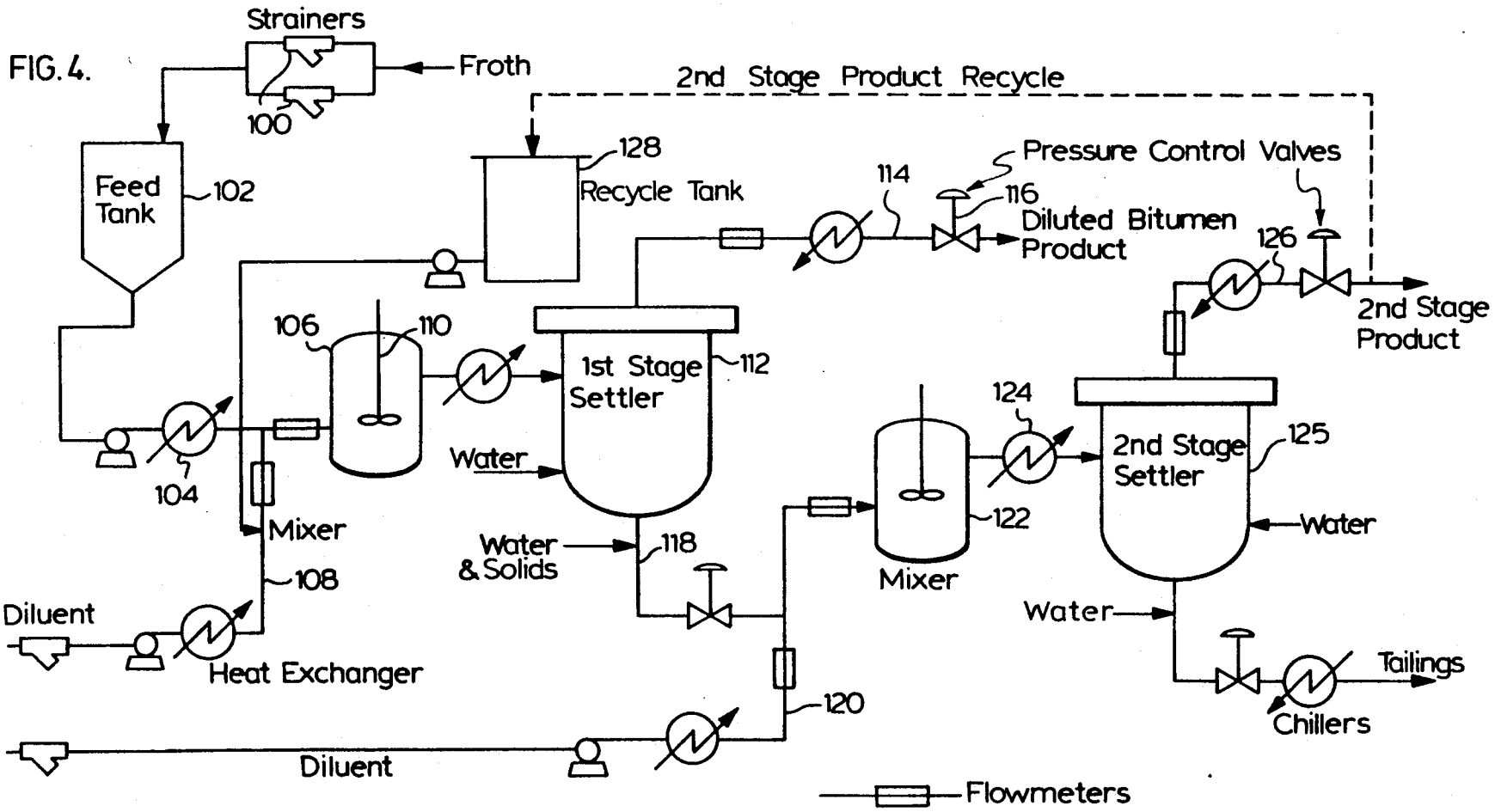
FIG. 4 is a schematic flow diagram of a continuous pilot process of the present invention.

A continuous pilot plant test base don the underlying principles of this invention was carried out in a two-stage configuration. The invention will now be described with respect to the two-stage configuration, although it could be carried out in three or more stages if this was advantageous for any given application. The flow scheme as test is represented in FIG. 4.

Feed to the unit was bituminous froth prepared by a commercial bitumen plant. The froth was heated and deaerated in a feed tank at atmospheric pressure and introduced under pressure to the mixing and separating stages of the process on a continuous basis. Details of stream compositions and process conditions are shown in Table 7.

TABLE 7

Pilot plant Demonstration of Froth Treatment Process

| | Wt % of Component | | | Naphtha | Temp | Pressure | Flow |
|---|---|---|---|---|---|---|---|
| Stream | Bitumen | Water | Solids | Wt % on Bit. | °C. | kPa | kg/min |
| Froth feed | 51 | 40.0 | 9.0 | N/A | 137 | 1400 | 0.72 |
| 1st stage feed | 39.3 | 30.7 | 6.0 | 24.6 | 137 | 1400 | 1.00 |
| 1st stage prod. | 58.1 | 2.0 | 0.4 | 39.6 | 137 | 1400 | 0.61 |
| 1st stage underflow | 9.6 | 76.0 | 14.7 | 0.9 | 137 | 1400 | 0.39 |
| 2nd stage feed | 3.9 | 61.4 | 6.0 | 29.2 | 117 | 1100 | 0.95 |
| 2nd stage recycle | 11.6 | 6.7 | 0.2 | 87.8 | 30 | 100 | 0.28 |

TABLE 7-continued

| | Pilot plant Demonstration of Froth Treatment Process | | | | | | |
|---|---|---|---|---|---|---|---|
| | Wt % of Component | | | Naphtha | Temp | Pressure | Flow |
| Stream | Bitumen | Water | Solids | Wt % on Bit. | °C. | kPa | kg/min |
| 2nd stage tailings | 0.8 | 86.2 | 8.4 | 4.7 | 110 | 1100 | 0.67 |

With reference now to FIG. 4, froth from an extraction process was pumped through strainers 100, to remove large solid particles, to a feed tank 102 which was maintained at a temperature of about 90° C. to effect deaeration. Deaerated froth was pumped through a heat exchanger 104 to a mixer 106 where diluent (naphtha), heated and pumped in separately through line 108, was mixed with the froth in vessel 106 equipped with motor-driven stirrer 110. The mixture was then further heated and fed under pressure to the first stage settling vessel 112. The hydrocarbon phase was removed as a light overhead stream 114, under pressure by control valve 116. The aqueous solids-containing underflow stream 118 with residual bitumen was withdrawn under liquid level control, then combined with further heated diluent through line 120 and mixed in second mixing vessel 122. This latter stream flowed through another heat exchanger 124 to the second stage settling vessel 125. Overhead product 126 from the second stage settler 125 could be recycled, via a recycle tank 128, to the first stage mixer 106, to obtain maximum utilization of diluent. Diluent can be added by line 120, line 108 or by a combination of both lines.

This pilot unit was fully instrumented with temperature and pressure sensors, and flowmeters, to permit extensive data-gathering and analysis.

With reference to Table 7, the first stage separation was carried out at a temperature of 137° C. under a pressure of 1400 kpa and the second stage separation was carried out at a temperature of 117° C. at a pressure of 1100 kPa Bitumen recovery relative to bitumen feed was about 93 wt% in the first separation stage with 5 wt% in the second separation stage for a total of 98.6 wt% recovery.

It will be understood, of course, that modifications can be made in the embodiment of the invention illustrated and described herein without departing from the scope and purview of the invention as defined by the appended claims.

What is claimed is:

1. A process for treating bitumen froth to separate a bitumen component thereof from a residual component containing water and solids, which comprises:

heating said bitumen froth to a temperature in the range of 100° C. to 300° C. under a pressure sufficient to maintain fluid components in the liquid state, and passing said froth to a plurality of separation stages in series for gravity separating water and solids form the bitumen while continuously maintaining the temperature int he range of 100° C,. to 300° C. and the pressure sufficient to maintain the fluid components in the liquid stage.

2. A process as claimed in claim 1, in which bitumen is removed from a first separation stage as a product and water, solids and residual bitumen are passed to a second separation stage for recovery of bitumen and withdrawal of water and solids for disposal.

3. A process as claimed in claim 2, in which the bitumen froth is preconditioned by efficient mixing in a mixing stage prior to passage to each separation stage.

4. A process as claimed in claim 3, in which a diluent consisting of a hydrocarbon miscible with the bitumen is added to at least one mixing stage in an amount of hydrocarbon diluent in the range of about 0 to 60 per cent by weight of the bitumen fed to the said mixing stage.

5. A process as claimed in claim 3, in which a diluent consisting of a hydrocarbon miscible with the bitumen is added to at least one mixing stage in an amount of hydrocarbon diluent int he range of about 15 to 50 per cent by weight of the bitumen fed to the said mixing stage.

6. A process as claimed in claim 5 in which said hydrocarbon diluent has the characteristics of a diluent selected from the group consisting of naphtha, kerosene, toluene and natural gas condensate.

7. A process as claimed in claim 6, in which the bitumen froth is heated to a temperature in the range of about 100° C . to about 180° C. and maintained at a pressure in the range of about 800 to about 2000 kPa/

8. A process as claimed in claim 6, in which at least a portion of ht diluent is recovered from the diluted bitumen product for recycle to a mixing stage.

9. A process as claimed in claim 5, in which the bitumen froth is heated to a temperature in the range of about 100° C. to about 180° C. and the heated bitumen froth is maintained at a pressure in the range of about 150 to about 5000 kPa.

10. A process as claimed in claim 5, in which the bitumen froth is heated to a temperature in the range of about 100° C. to about 180° C. and maintained at a pressure in the range of about 800 to about 2000 kPa.

11. A process as claimed in claim 5, in which at least a portion of the diluent is recovered form the diluted bitumen product for recycle to a mixing stage.

12. A process as claimed in claim 1, in which the bitumen froth is heated to a temperature in the range of about 100° C. to about 180° C. and the heated bitumen froth is maintained at a pressure in the range of about 150 to about 5000 kPa.

13. A process as claimed in claim 12, in which the bitumen froth is heated to a temperature in the range of about 100° C. to about 180° C. and maintained at a pressure in the range of about 800 to about 2000 kPa.

14. A process as claimed in claim 1, in which the bitumen froth is heated to a temperature in the range of about 100° C. to about 180° C. and maintained at a pressure in the range of about 800 to about 2000 kPa.

15. A process as claimed in claim 5, in which the bitumen froth is heated to a temperature in the range of 80° C. to 100° C. and passed to a dearation stage at atmospheric pressure prior to passage to a first separation stage.

* * * * *